US005336114A

United States Patent [19]

Wang

[11] Patent Number: 5,336,114

[45] Date of Patent: Aug. 9, 1994

[54] COPPER BLADE SECURING STRUCTURE OF TAIL FEMALE RECEPTACLES

[76] Inventor: Ming Y. Wang, 33-8, Fan Gee Pore, Tai Ho Li, Chupei City, Hsinchu Shien, Taiwan

[21] Appl. No.: 64,238

[22] Filed: May 21, 1993

[51] Int. Cl.[5] ..... H01R 13/40

[52] U.S. Cl. ..... 439/598; 439/650; 439/686

[58] Field of Search ..... 439/600, 601, 603, 621, 439/622, 686, 647-650, 597, 598, 599

[56] References Cited

U.S. PATENT DOCUMENTS 2,255,763 9/1941 Doughman ..... 439/598
3,003,133 10/1961 Herman et al. ..... 439/597
3,437,980 4/1969 Smith ..... 439/598
4,834,664 5/1989 Lin ..... 439/622

*Primary Examiner*—Larry I. Schwartz
*Assistant Examiner*—Hien D. Vu
*Attorney, Agent, or Firm*—Morton J. Rosenberg; David I. Klein

[57] ABSTRACT

A copper blade securing structure of tail female receptacles mainly uses a flexible fastening mechanism to combine a housing and an insertion portion, forming a firm connection and rigidly grasping wires. Besides, with the aids of notches and protrusions, the conductor wires of light bulb series can be firmly set inside the receptacle, without the trouble of faltering copper plates.

2 Claims, 5 Drawing Sheets

COPPER BLADE SECURING STRUCTURE OF TAIL FEMALE RECEPTACLES

BACKGROUND OF THE INVENTION

Inside a conventional tail female receptacle of light bulb series, the copper plates connected with conductor wires are usually placed into the grooves formed inside the housing of receptacles that have not a firm holding function to the copper plates so that the copper plates often have faltering phenomena, which in turn leads to an unstable contact between the copper plates and the copper blades of plugs resulting in a safety problem. furthermore, the connections between the conductor wires and tail receptacles simply rely on joining the conductor wires to the ends of copper plates. When in use, the tail receptacles are easily disconnected with the wires, resulting in potential dangers to people.

OBJECT OF THE INVENTION

In view of that, the principal object of the invention is to provide a structure using a flexible fastening mechanism to combine a housing and an insertion portion to secure firmly conductor wires. Another object of the invention is to provide a safe reliable structure that allows copper plates being rigidly inserted into the grooves formed in the insertion portion so that no loosening would happen.

DETAILED DESCRIPTION

Figure 1:
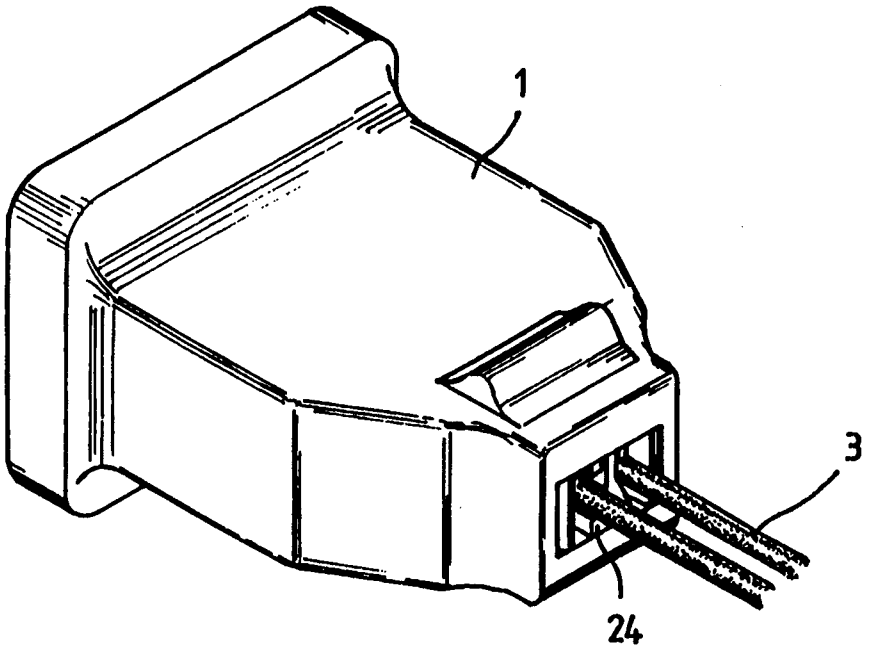
FIG. 1 is a perspective view showing the exterior appearance of an embodiment according to the invention.
Figure 2:
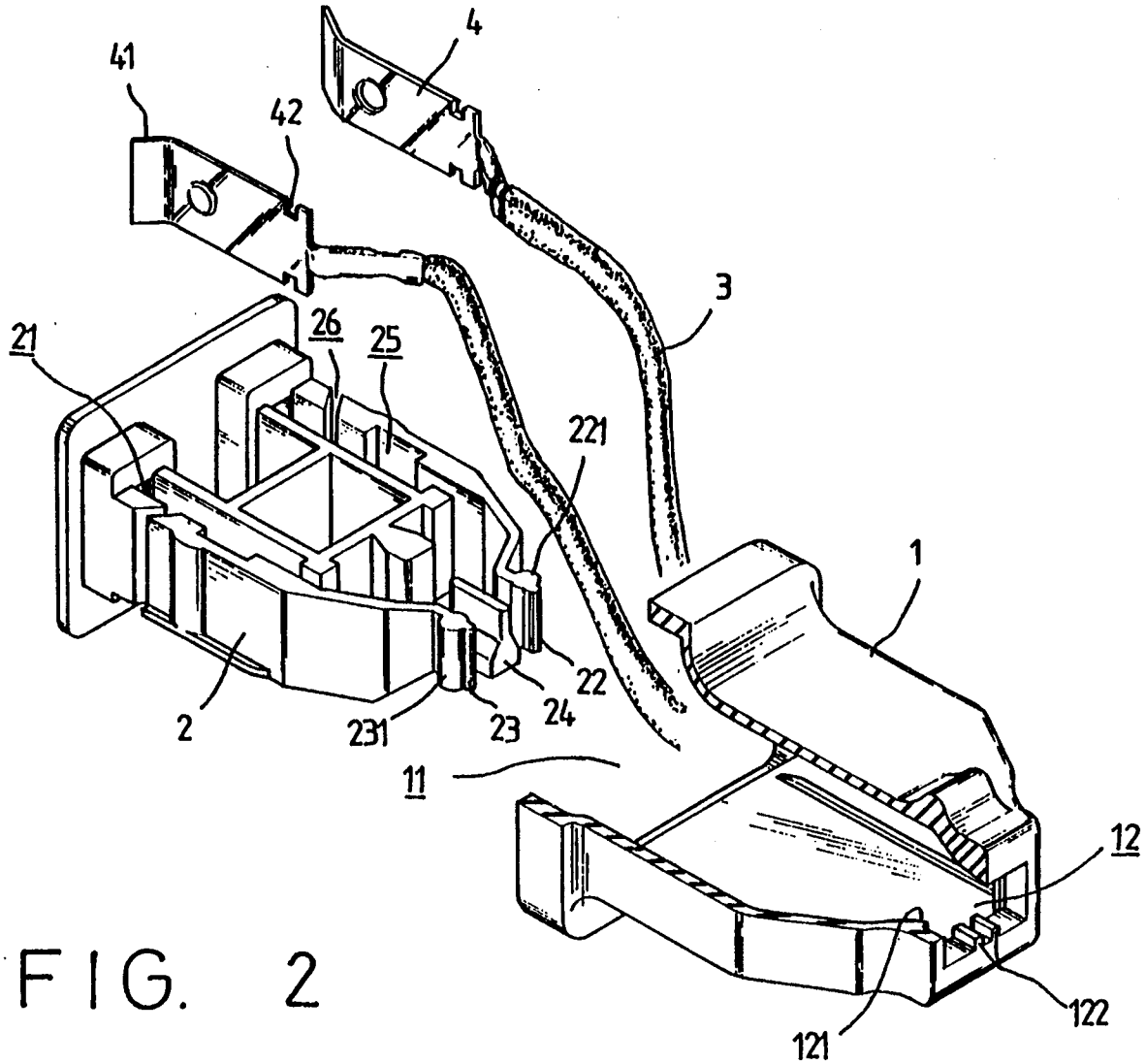
FIG. 2 is an exploded perspective view of the embodiment shown in FIG. 1.
Figure 3:
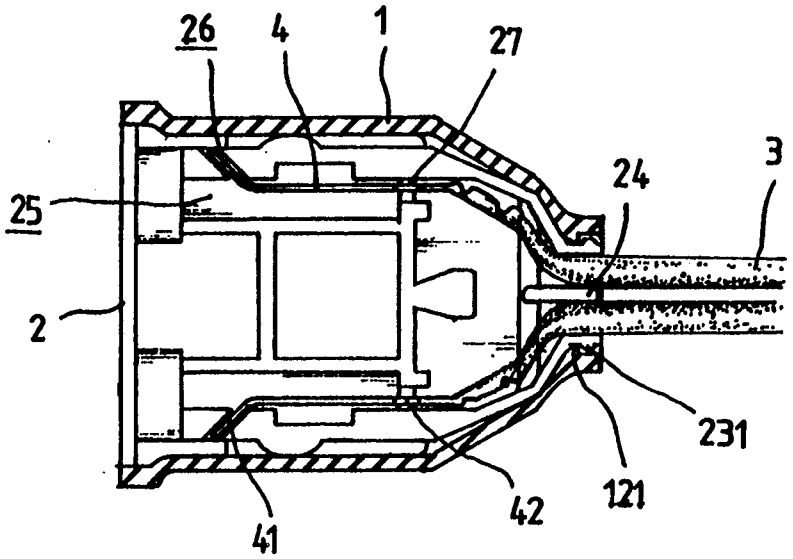
FIG. 3 is a schematic plan view of the invention.
Figure 4:
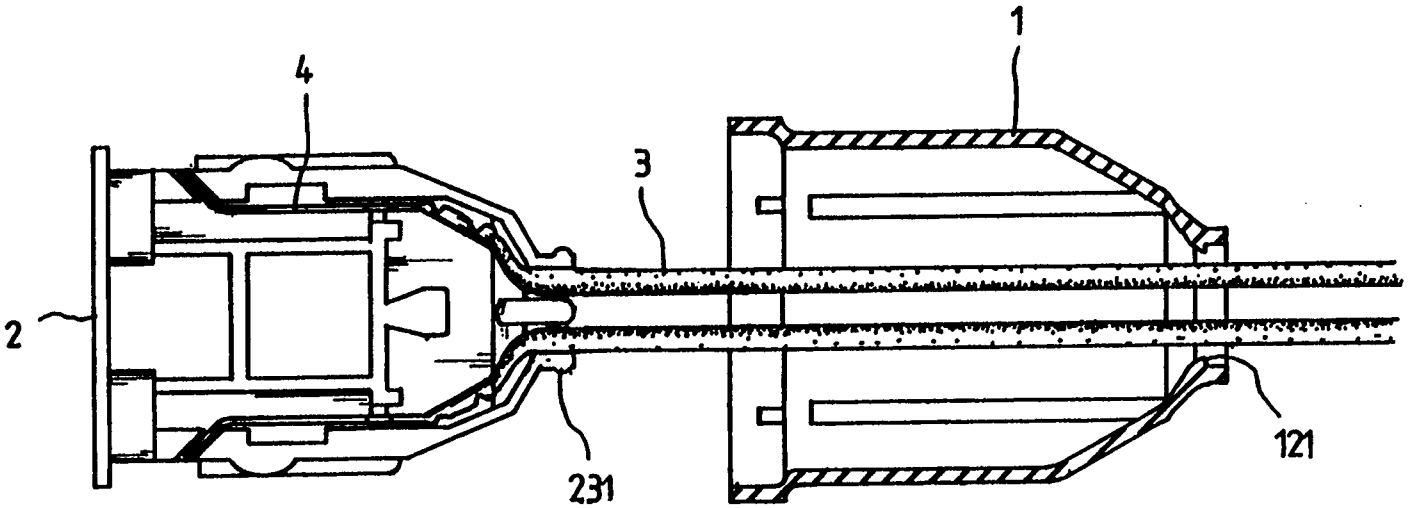
FIG. 4 is a schematic view indicating the action putting the insertion portion into the housing.
Figure 5:
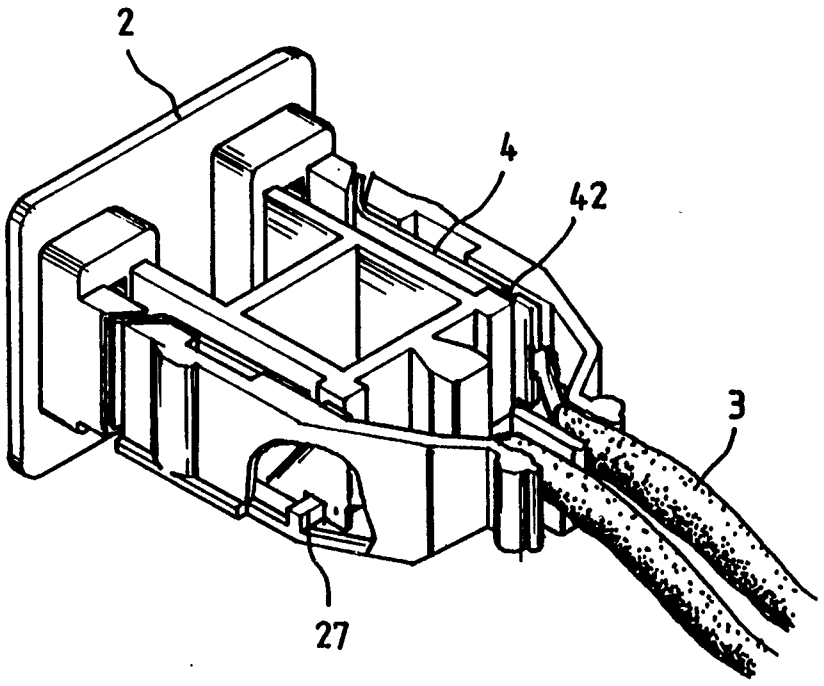
FIG. 5 is a schematic view showing the invention, partly in cross section.

As can be seen in FIGS. 1 and 2, the invention mainly comprises a housing (1), an insertion portion (2), conductor wires (3), and copper plates (4). The housing (1) is a hollow shell body with a large opening (11) on one end for accommodating the insertion portion (2), and a small opening (12) on the other end. Inside the small opening (12) there are hook portions (121) formed on two sides thereof and two protrusions (122) situated on the middle area near the lower edge of the opening. The interior structure of the insertion portion (2) is shown in these figures, chiefly including three generally parallel, outward projecting and suspending pillars (22), (23), (24) among which the pillars (22), (23) have fastening portions (221) and (231) respectively and the vertical end surface of the pillar (24) shows a configuration having a slender upper half and a thick lower half.

In addition, the grooves (25) accommodating copper plates (4) and conductor wires (3), the notches (26) holding the tail ends of the copper plates (4), and the lugs (27) securing the middle segments of copper plates (4) are provided on the central area of the insertion portion. Conductor wires (3) are common power cords used for light bulb series, which wires are connected to one end of copper plates (4) in a way known to the public. The other end of copper plates (4) is a bent portion (41) and notches (42) are disposed on two sides of copper plates at proper positions. To assemble these components, the conductor wires (3) and the copper plates (4) are placed into the grooves (25) of the insertion portion (2) in the manner of the bent portions (41) and the notches (42) engaging with the notches (26) and the lugs (27) respectively. And so the copper plates (4) obtain a firmly setting. Moreover, the conductor wires are routed through the gaps among three pillars (22), (23), (24) which have the widths approximately equivalent to the wire diameter and then pass through the opening (11), (12) of the housing (1). When the insertion portion enters the opening (12), due to the confinement of the hook portions (121), the fastening portions (221), (231) are squeezed inwards, which in turn urges wires (3). After the insertion portion passed the hook portions, the confinement disappears and the fastening portions (221), (231) spring back to their original configurations to engage with the hook portions (121). Thus, the combination of the insertion portion (2) with the housing (1) forms a rigid connection which cannot be separated unless the external force exceeds the strength of material. The grasp of the fastening portion (221), (231) at the hook portions (121) is restricted by the wire diameter and so no loosening can happen. On the other hand, the copper plates are also bound by the notches (26) and the lugs (27), and so when in use, the copper plates will not falter or glide, eliminating possible dangers to people.

As described above, by a subtle arrangement of notches and pillars, the invention can obtain the effect of firmly securing wires, improve the shortcomings of a conventional tail female receptacle, and significantly promote safety and the practical value. The new structure of the invention has never been disclosed, either. Accordingly, it is requested to grant a patent to the applicant.

What is claimed is:

1. A copper blade securement structure for tail female receptacles comprising:

(a) a pair of electrical conductor wires;

(b) a pair of copper plates extending in a longitudinal direction, each of said copper plates having a first end section inclined with respect to a second end section, each of said electrical conductor wires being electrically coupled to each of said second end sections of said copper plates;

(c) a hollow housing extending in said longitudinal direction, said hollow housing having a first opening formed through a first end thereof and a second opening formed through a second end thereof, said first opening having a greater cross-sectional area than said second opening, said second end of said housing having a pair of hook members extending transversely at least partially into said housing second opening, and a pair of protrusion members extending in a vertical direction at least partially into said housing second opening; and, (d) an insertion member having a forward end section for insert into said hollow housing through said housing first end opening, said insertion member having a pair of longitudinally directed and transversely displaced grooves formed therein forming opposing transversely displaced insertion member sidewalls having respective inclined notches formed therein for insert of a respective inclined first end of a respective copper plate, said insertion member forward end section having a pair of transversely displaced pillar members extending in said longitudinal direction and formed integral with a respective insertion member sidewall, each of said transversely displaced pillar members having a transversely directed fastening member for interface with a respective hook member when said insertion member is inserted into said hollow housing, said insertion member having a central pillar member extending longitudinally from said insertion member forward end section between said transversely displaced pillar members for forming a pair of gaps between said pillar members, said gaps in open communication with respective grooves of said insertion member for insertion therein of said electrical conductor wires.

2. The copper blade securement structure as recited in claim 1 wherein said pair of protrusion members are transversely displaced in said second opening for engaging with said central pillar member of said insertion member.

* * * * *